United States Patent [19]

Melotti

[11] 4,212,277

[45] Jul. 15, 1980

[54] ECONOMY THROTTLE BODY FOR HOT FUEL HANDLING

[75] Inventor: Angelo R. Melotti, Troy, Mich.

[73] Assignee: The Bendix Corporation, Southfield, Mich.

[21] Appl. No.: 883,553

[22] Filed: Mar. 6, 1978

[51] Int. Cl.[2] ..... F02M 39/00; F02B 3/00; B05B 1/30

[52] U.S. Cl. ..... 123/434; 123/472; 261/50 A; 239/585

[58] Field of Search ..... 123/139 AW, 119 R, 32 AE; 261/78 R, 79 R, 50 A; 239/585, 124, 125, 126, 88

[56] References Cited

U.S. PATENT DOCUMENTS

| | | | |
|---|---|---|---|
| 2,130,666 | 9/1938 | Coffey | 239/585 |
| 2,163,139 | 6/1939 | Brandon | 261/79 R |
| 3,610,213 | 10/1971 | Gianini | 123/139 AW |
| 3,635,,201 | 1/1972 | High | 123/119 R |
| 3,877,449 | 4/1975 | High | 123/119 R |
| 3,930,481 | 1/1976 | Eckert | 123/32 AE |
| 3,943,904 | 3/1976 | Byrne | 123/119 R |
| 3,996,906 | 12/1976 | Bubniak et al. | 123/119 R |

*Primary Examiner*—P. S. Lall

*Attorney, Agent, or Firm*—William A. Marvin; Russel C. Wells

[57] ABSTRACT

An economy throttle body for a single point fuel injection system is disclosed. The throttle body is formed from two integrally molded throttle body members. An upper member contains provision for the mounting two electronic solenoid injectors and an arrangement of fuel control passages while a lower throttle body member is utilized to mount the throttle body onto an engine manifold and contains the air induction bores and throttle assemblies of the system. Hot fuel handling capability is provided by a heat resistant thermal isolation seal separating the upper and lower throttle body members. Upwardly canted fuel delivery passages further enhance the hot fuel handling capability of the upper throttle body member.

11 Claims, 2 Drawing Figures

ECONOMY THROTTLE BODY FOR HOT FUEL HANDLING

BACKGROUND OF THE INVENTION

The invention pertains generally to single point fuel injection systems and is more particularly directed to an economy throttle body configuration for the hot fuel handling problems of such systems.

Electronic fuel injection systems utilizing single point throttle bodies are becoming more of a reality with the exacting control of new fuel injectors and sophisticated electronic control systems. The fuel handling and delivery capabilities of such systems will entice automotive manufacturers to replace regular and pressure carburetion systems with such new assemblies.

The hot fuel handling capability of single point systems may at times cause difficulties in the regulation of the amount of fuel delivered to the internal combustion engine. When heat is transferred from the manifold of an engine to a throttle body, the normally liquid fuel vaporizes and causes bubbles or blocks which when metered through an exactly timed opening of an electronic fuel injector will produce significant discrepancies in the air/fuel ratio.

Further, relatively costly machining and special configurations are needed to mount the electronic fuel injectors and throttle bodies that have been used in prior configurations.

SUMMARY OF THE INVENTION

The invention provides an economical, low cost throttle body which eliminates many of the potential difficulties with hot fuel handling.

The throttle body is comprised of an upper throttle body member and a lower throttle body member separated by a thermal barrier. The thermal barrier prevents the transfer of heat from the manifold of the engine to the upper throttle body member which contains the fuel passages of the system and mounts the injectors into the air induction bores of the throttle body. Specially angled fuel passages in the upper throttle body member eliminate bubbles and vapor locks during fuel delivery.

Each throttle body member is cast or formed for the minimum amount of machining and requires few assembly parts. The simplified dual member configuration not only reduces machining costs to a minimum but also permits different materials to be used for each member. In the preferred embodiment the upper throttle body member is formed of a material which facilitates weight reduction.

DETAILED DESCRIPTION OF THE DRAWINGS

Figure 1:
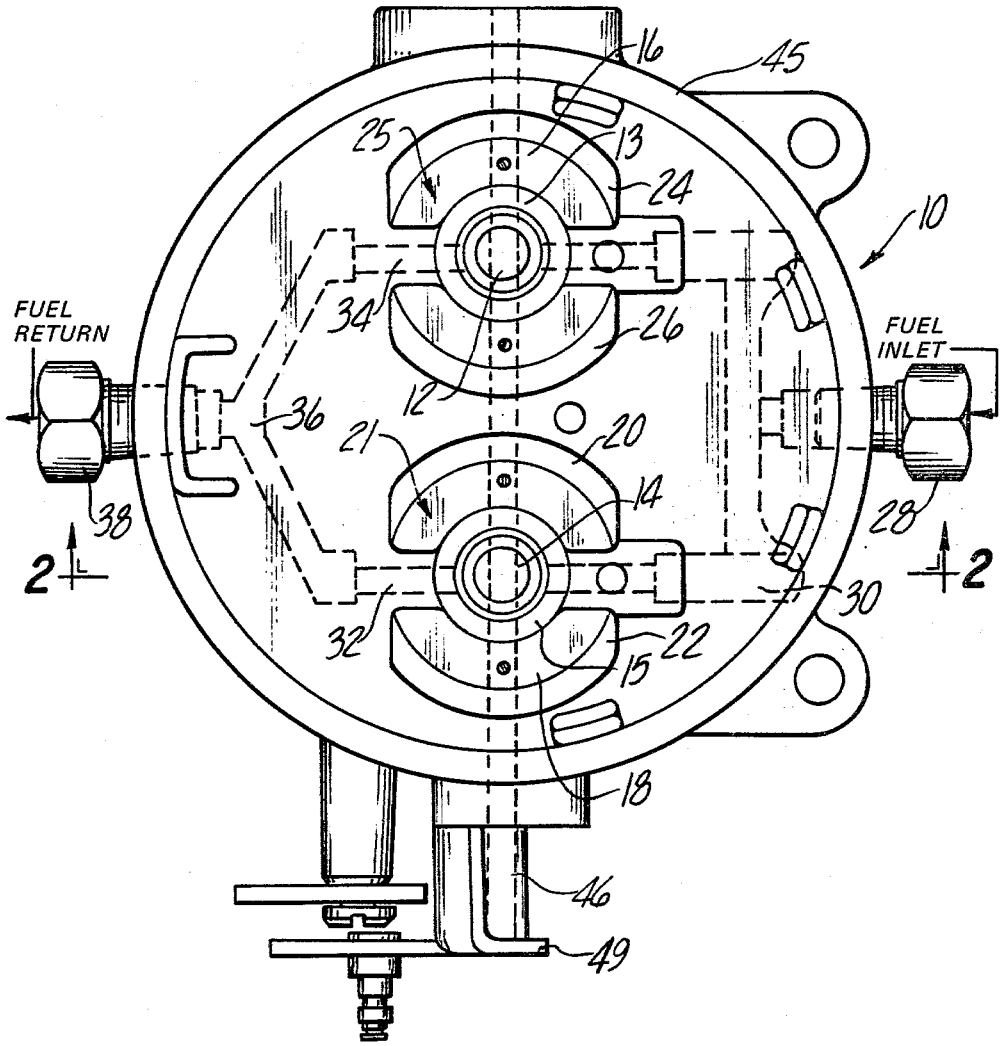
FIG. 1 is a top view of a throttle body assembly of a single point fuel injection system according to the invention.
Figure 2:
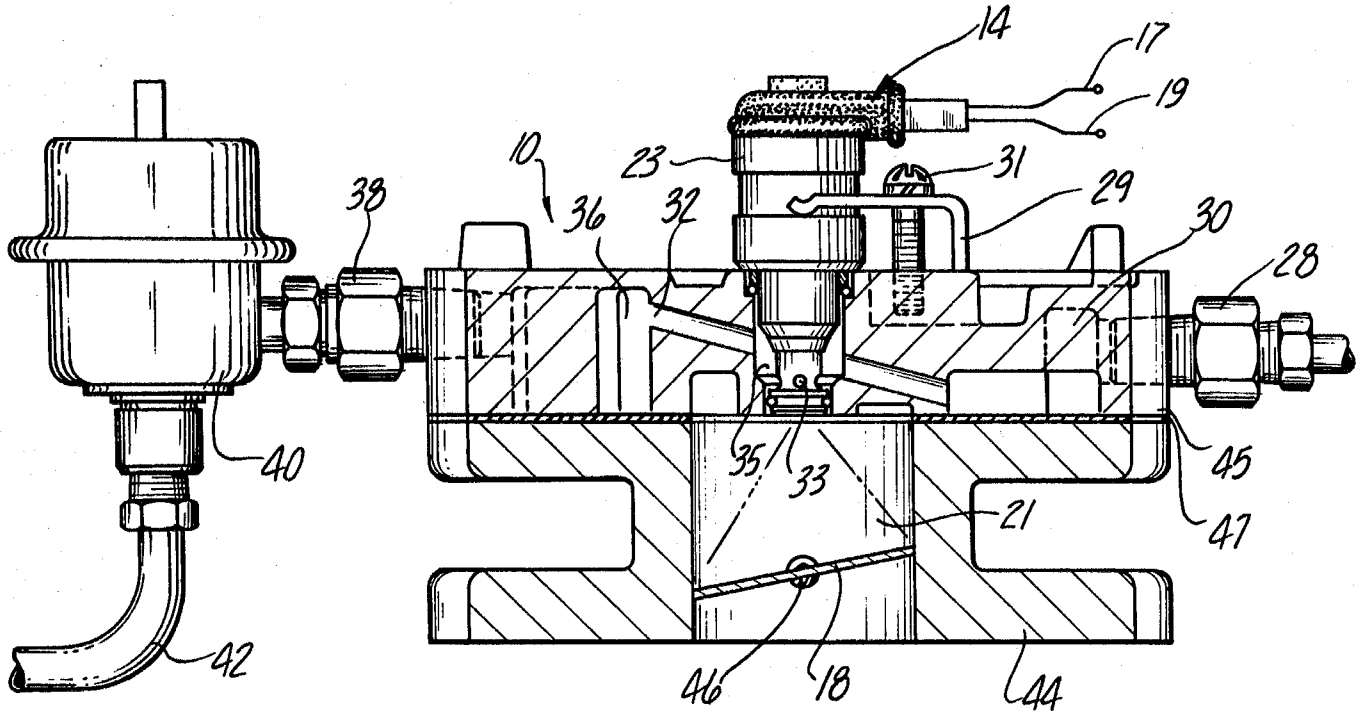
FIG. 2 is a partially cross-sectioned side view of the throttle body illustrated in FIG. 1 with a mounted electronic fuel injector.

The throttle body 10 illustrated in FIGS. 1 and 2 comprises basically an upper throttle body member 45 and a lower throttle body member 44. The upper and lower members are separated at their interface by a thermal barrier layer 47. The thermal barrier extends across the entire interface and is provided with only two apertures centered on air induction bores 21,25. Theupper and lower members 44,45 are joined in a conventional manner by bolts or the like (not illustrated).

The thermal barrier 47 can be any insulating material that is resistant to the transmission of heat and will not break down with fuel contact. Preferably the thermal barrier is a celluous fiber cork nitrile rubber. This material is commercially available as a gasket material CN 705 from the Armstrong Cork Corporation. According to one of the important objects of the invention, the upper throttle body member is thereby insulated from the lower throttle body member.

Upper throttle body member 45 is formed as an integral element with accumulation jackets 13, 15 suspended by lateral wings concentrically in the generally cylindrical air induction bores 21, 25. FIG. 1 shows a top view without electronic fuel injectors mounted at positions 12, 14 while in FIG. 2 the fuel accumulation jacket 15 has an injector 23 mounted at 14 within the jacket. Each accumulation jacket, for example 15, supports the injector 23 on a circular shoulder and provides an accumulation chamber 35 which feeds the injector with fuel. The injector 23 is inserted into the accumulation chamber 35 and is sealed from leaking with suitable means such as O-rings.

The upper throttle body 45 is further formed with an inlet accumulator 30 into which an inlet fitting 28 delivers fuel from a pressurized source. Preferably, the source is a standard fuel pump capable of obtaining between 7–15 psi. From the accumulator 30, the fuel flows through fuel delivery passages 32 and 34 into the injector jackets and thereafter to an outlet accumulation channel 36 which is tapped with an outlet fitting 38. Accumulator 30 and accumulator 36 are of substantially similar volumes to assist in maintaining a constant pressure across the fuel delivery passages.

Both accumulator 30, 36 are generally C-shaped as viewed from above. The inlet accumulator 30 has shallow long connecting legs of the C while outlet accumulator 36 has narrow deep connecting legs of the C. This shape of the accumulator provides a maximum angle for the fuel passages (for example in FIG. 2) where vapor, bubbles and cavitations will move toward the outlet accumulator. Further, fuel inlets 33 to the injector 23 are positioned below the fuel delivery passage to aid in the movement of vapors caused by the injector or otherwise toward the accumulator 36.

It is seen that the upper throttle body is an extremely facile to manufacture with very few machining operations to provide a mounting structure for the injector and fuel flow passages. The only machining operations that are required for the member are the mounting bolt threads (not shown), the fuel flow passages 34 and 32 which are provided as straight upwardly canted drill bores, the two inlets to the accumulators 30,36 and drill bores for a screw 31 and mounting clip 29.

The upper throttle body member may be made of a hard durable plastic or the like for lightness and molding facility as it is thermally insulated from the manifold and need not withstand extreme engine heat. The accumulator 30 communicates with accumulator 36 via passages 32, 34 and recirculates fuel between the inlet 28 and outlet 38 by means of the pressure source. The pressure in the system is adjustable by means of a standard pressure regulator 40 regulating the flow of fuel through the return conduit 42 to the source. Preferably, the system is operated at a relatively low pressure. Both accumulators 30, 36 are sealed by the thermal barrier 47 from the lower throttle member 44 to prevent vaporization of the fuel by the heat of the manifold. This construction simplifies the molding of the upper throttle member as the accumulators 30,36 can be open chambers and only sealed upon assembly with the thermal barrier and lower throttle body member 44.

Below is the lower throttle body member 44 which mounts on a standard two-plane internal combustion engine manifold and is manufactured of a light material such as aluminum. The lower member 44 is molded such that large thin areas of the member provide heat transfer characteristics to the ambient atmosphere. The lower throttle body member includes provision for the air induction bores and the mounting of throttle assemblies comprising throttle plates 16, 18 ganged on a rotatable throttle rod 46. The throttle rod is rotated, as is conventional, under operator control by the connection of an accelerator (not shown) to a throttle linkage 49.

In operation, the amount of air inducted into bores 21, 25 is dependent upon the control of the throttle plate openings. Fuel is metered into the openings between throttle plate and induction bore wall by the opening of the solenoid injectors. A hollow cone of fuel is sprayed or directed into the openings through a metering orifice of the injector from the accumulation chamber 35 of the injector jacket 15.

An advantageous injector 23 shown in FIG. 2 at 14 is preferably used for mounting in the thorttle body 10 is described more fully in a copending application erial No. 580-78-0430 entitled "Fuel Injection Valve and Single Point System", in the name of Angelo Melotti, the disclosure of which is hereby incorporated by reference herein. The intermittent timing of the injector 23 is also more fully described therein. Generally, injection takes place by energizing terminals 17 and 19 by electrical pulse widths that begin some angular measurement before each intake valve of the engine opens.

While a preferred embodiment has been shown, it will be obvious to those skilled in the art that modifications and changes may be made to the disclosed system without departing from the scope of the invention as defined by the appended claims.

Having described the invention, what is claimed is:

1. A throttle body for attachment to a manifold of an internal combustion engine, said throttle body comprising:

an upper throttle body member having integral fuel passages for the delivery of pressurized fuel to at least one air induction bore disposed therethrough and means for mounting a fuel injector in the air flow path of that bore, said fuel injector operable to meter said pressurized fuel from said fuel passages;

a lower throttle body member, adapted to mount between said upper throttle body and the manifold of the internal combustion engine, having said bore further disposed therethrough and including a throttle means located in said bore to control the amount of air flow thereghrough; and a thermal barrier separating said upper member from said lower member to prevent substantial thermal energy from reaching the fuel passages of the upper member from the manifold and thereby causing hot fuel handling problems.

2. A throttle body as defined in claim 1 wherein said fuel passages include:

an inlet accumulation chamber and an outlet accumulation chamber connected by fuel delivery passages, said inlet accumulation chamber adapted to receive pressurized fuel and communicate said fuel through said fuel delivery passages to the outlet accumulation chamber; and said injector mounting means includes an accumulator jacket communicating with said fuel delivery passages to bring fuel to said injector adapted to inject fuel from said accumulator jacket.

3. A throttle body as defined in claim 2 wherein said inlet accumulation chamber and said outlet accumulation chamber are open to the surface of the upper throttle body member that mates with the lower throttle body member, said thermal barrier further sealing the open accumulation chambers.

4. A throttle body as defined in claim 3 wherein said thermal barrier is:

a celluous fiber cork nitrile rubber.

5. A throttle body as defined in claim 4 wherein said inlet accumulation chamber and outlet accumulation chamber contain substantially equivalent volumes.

6. A throttle body as defined in claim 5 wherein:

said fuel delivery passages are inclined such that the fuel flows upwardly from the inlet accumulator to the outlet accumulator.

7. A throttle body as defined in claim 6 wherein:

said injector has fuel inlets located in said accumulator jackets that are below said fuel delivery passage.

8. A throttle body as defined in claim 7 wherein:

said injector mounting means mounts said injector concentrically with said air induction bore above the throttle means.

9. A throttle body as defined in claim 8 wherein:

said throttle means includes a moveable throttle member presenting increasing or decreasing areas between the air induction bore wall and the throttle member.

10. A throttle body as defined in claim 9 wherein:

said injector sprays a hollow conical pattern of fuel directed at the areas between said throttle member and air induction bore wall.

11. A throttle body as defined in claim 10 wherein:

said throttle body further includes a regulating pressure means for maintaining substantially constant fuel pressure in said accumulation chambers.

* * * * *